US006775896B2

(12) United States Patent
Dudek et al.

(10) Patent No.: US 6,775,896 B2
(45) Date of Patent: Aug. 17, 2004

(54) METHOD OF SECURING COMPLEMENTARY FASTENER STRIPS

(75) Inventors: Chester P. Dudek, Marietta, GA (US); James Hutcherson, Norcross, GA (US); Kiichiro Ishikawa, Marietta, GA (US); Tomonari Yoshida, Marietta, GA (US)

(73) Assignee: YKK Corporation of America, Marietta, GA (US)

( * ) Notice: Subject to any disclaimer, the term of this patent is extended or adjusted under 35 U.S.C. 154(b) by 161 days.

(21) Appl. No.: 10/082,316

(22) Filed: Feb. 26, 2002

(65) Prior Publication Data

US 2002/0124358 A1 Sep. 12, 2002

Related U.S. Application Data

(62) Division of application No. 09/802,992, filed on Mar. 12, 2001, now Pat. No. 6,449,816.

(51) Int. Cl.[7] ..... A44B 18/00

(52) U.S. Cl. ..... 29/417; 29/428; 24/306; 24/442

(58) Field of Search ..... 24/306, 442, DIG. 11, 24/265 C, 16 R, 130; 128/DIG. 15; 2/912; 428/100; 297/452.18, DIG. 6, 228.12; 29/91, 91.1, 428, 417

(56) References Cited

U.S. PATENT DOCUMENTS

| | | | | |
|---|---|---|---|---|
| 4,094,021 A | | 6/1978 | Rapp | |
| 4,546,879 A | * | 10/1985 | Viscasillas | 206/391 |
| 4,723,723 A | * | 2/1988 | Asahi et al. | 242/566 |
| 4,759,963 A | * | 7/1988 | Uso, Jr. et al. | 428/100 |
| 4,862,563 A | * | 9/1989 | Flynn | 24/442 |
| 5,136,759 A | | 8/1992 | Armour, II | |
| 5,142,743 A | * | 9/1992 | Hahn | 24/16 R |
| 5,214,874 A | * | 6/1993 | Faulkner | 43/25.2 |
| 5,289,619 A | * | 3/1994 | Pileggi | 24/306 |
| 5,669,120 A | | 9/1997 | Wessels et al. | |
| 6,049,953 A | * | 4/2000 | McCay et al. | 24/302 |
| 6,175,980 B1 | * | 1/2001 | Gaither | 5/654 |
| 6,235,369 B1 | * | 5/2001 | Shepard et al. | 428/85 |
| 6,290,293 B1 | * | 9/2001 | Long et al. | 297/228.12 |
| 6,588,840 B1 | * | 7/2003 | Lombardo | 297/228.12 |

FOREIGN PATENT DOCUMENTS

| | | |
|---|---|---|
| JP | 62-203739 | 12/1987 |
| JP | 10-115307 | 5/1998 |

* cited by examiner

*Primary Examiner*—David P. Bryant
*Assistant Examiner*—Jermie E. Cozart
(74) *Attorney, Agent, or Firm*—Kramer & Amado, P.C.

(57) ABSTRACT

A method of providing complementary fastener strips for securing one item to another item is disclosed. A dispenser allows for complementary fastener strips in a prebound configuration, to be dispensed and used in applications such as the manufacture of outdoor furniture cushions. The invention facilitates the efficient and cost effective manufacture of articles which utilize multiple strips of complementary fastener strips.

8 Claims, 4 Drawing Sheets

METHOD OF SECURING COMPLEMENTARY FASTENER STRIPS

RELATED APPLICATIONS

This is a divisional of application No. 09/802,992, filed Mar. 12, 2001, now U.S. Pat. No. 6.449,816, which is hereby incorporated by reference.

BACKGROUND OF THE INVENTION

1. Field of the Invention

This invention generally relates to complementary fastener strip products. In particular, this invention relates to the manufacture and ready to use dispensing of complementary fastener strips for more efficient manufacture of furniture cushion attachments.

2. Description of Related Art

Complementary fastener strips are well know in the art and are used for a large variety of applications. These complementary fasteners include hook and loop fasteners manufactured in many configurations. U.S. Pat. No. 5,669,120, issued to Roger Thor Wessels et al. discloses a representative molded surface fastener which illustrates one construction of the hook and loop fasteners currently know in the art. Said fastener comprises molded hook elements and loop elements made of fibers which are mixedly distributed. The complementary fasteners currently known may be manufactured through extrusion, molding and injection-molding techniques, among other methods of manufacture. These types of fasteners may also be constructed through a weaving or knitting process to produce the finished product.

Complementary fastener strips are commonly used in many applications for releasably attaching and removing different articles of manufacture. An example of such use is illustrated in U.S. Pat. No. 5,136,759 issued to Thomas W. Armour, II. In Armour, II a multipurpose fastening device is used for securing items to stationary objects, or alternatively, for bundling elongated items of rope-like material. Armour, II discloses a webbing product, preferably constructed from either nylon or polypropylene, having hook and loop surfaces on one or both faces of the webbing. The webbing may be of different lengths and is used for attachment of, for example, soccer nets to goal posts and securing sails of a sailboat to a mast.

Another application of such complementary fasteners may be found in U.S. Pat. No. 4,094,021, issued to Robert A. Rapp. Rapp utilizes tie members, in the form of complemental fastening means, to attach a pool cover to the side walls of a pool below the pool deck. The complemental fastening means are secured to the pool cover through the use of rivets. The pool cover may then be extended above the surface of the pool and safely secured to the bordering side walls.

The furniture industry, and more particularly, the outdoor furniture industry utilizes complementary fasteners to fasten various articles to its furniture. In particular, there is a need for cushions to be removably secured to outdoor furniture. Outdoor furniture must ordinarily deal with adverse weather conditions such as wind, rain and snow. During periods of use, it is advantageous to secure cushions to outdoor furniture for greater comfort. During periods of non-use it is preferable to remove these cushions for storage and to prevent deterioration of said cushions due to their exposure to the elements. Complementary fastener strips prove to be particularly useful for this industry since the cushions may be secured to the furniture during use and may then be easily removed for storage.

In the manufacture of outdoor furniture cushions, it is presently the preferred practice to withdraw a desired length of complementary fastener strip, withdraw a second length of complementary fastener strip, and cut these in equal lengths. The strips are then sown to the cushion liner or the internal cushion filler.

Although the use of complementary fastener strips for attaching or securing objects is well know in the art, there continues to be a need for providing an efficient and cost effective process for providing such complementary fastener strips, in a ready to use configuration, during the manufacture of many of the products which rely on these essential articles of manufacture.

Thus, it is an object of the present invention to provide for the efficient and cost effective dispensing of preassembled complementary fastener strips for attachment to articles.

It is another object of the present invention to provide a first and second length of complementary fastener strips. Binding said fastener strips, and providing a container for dispensing said complementary fastener strip product.

It is a further object of the present invention to provide for the more efficient and cost effective manufacture of articles of manufacture which require the use of complementary fasteners in their fabrication.

The foregoing objects and advantages of the invention are illustrative of those that can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variation which may be apparent to those skilled in the art. Accordingly, the present invention resides in the novel methods, arrangements, combinations and improvements herein shown and described.

SUMMARY OF THE INVENTION

In light of the present need for providing an efficient and cost effective process for providing complementary fastener strips, a brief summary of the present invention is presented. Some simplifications and omission may be made in the following summary, which is intended to highlight and introduce some aspects of the present invention, but not to limit its scope. Detailed descriptions of a preferred exemplary embodiment adequate to allow those of ordinary skill in the art to make and use the invention concepts will follow in later sections.

A method is provided for securing complementary fastener strips. This is achieved by providing a first length of a fastener strip which has at least one complementary fastening face. Providing a second length of a fastener strip which also has at least one complementary fastening face. Binding the second fastener strip to the first fastener strip at an intermediate location along the first length of fastener strip. The first length of fastener strip being bound to the second length of fastener strip so that the complementary face of one fastener strip abuts a non-complementary face of the other fastener strip.

BRIEF DESCRIPTION OF THE DRAWINGS

In order to better understand the present invention, reference is made to the accompanying drawings, wherein.

DETAILED DESCRIPTION OF THE PREFERRED EMBODIMENTS OF THE INVENTION

Figure 1:
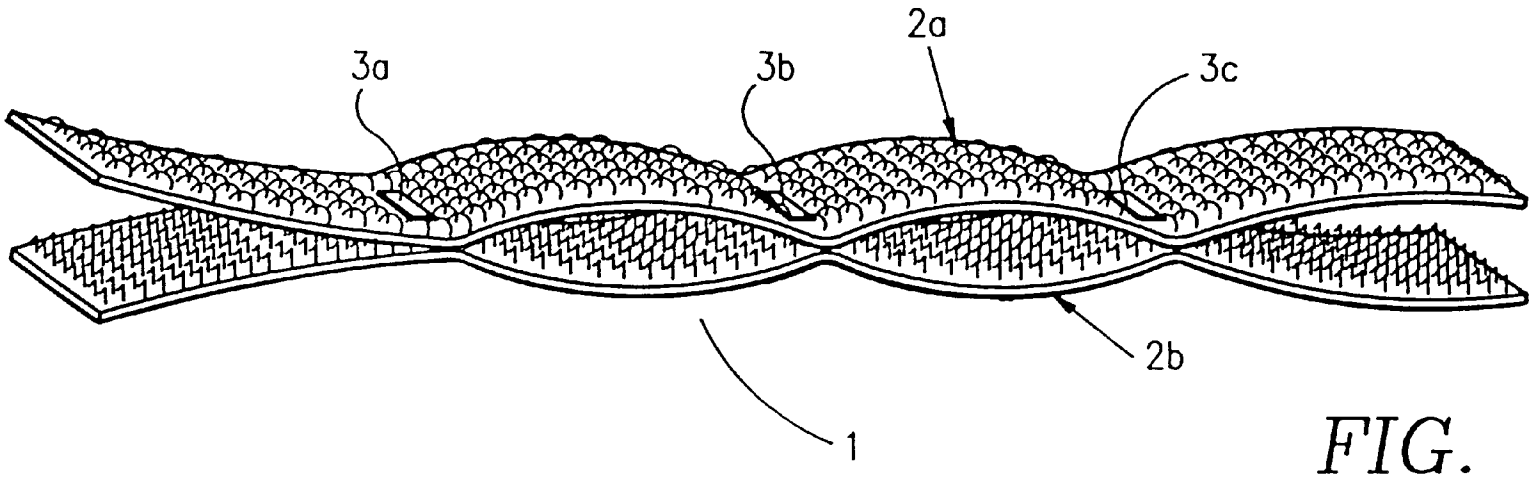
FIG. 1 shows a perspective view of one of the embodiments of the complementary fastener strip product.

Referring now to the drawings, in which like numerals refer to like components or steps, there are disclosed broad aspects of the preferred embodiments of the present invention. The embodiments shown include complementary fasteners which may be manufactured according to manufacturing processes commonly know in the art. These include extrusion, molding, injection-molding, weaving, knitting techniques, as well any other manufacturing processes commonly know for the manufacture of such fasteners. By complementary fasteners, the present invention encompasses the numerous products which allow for one portion of material having a profiled structure, to complementary engage a second portion of material having a profiled structure. These include hook and loop, surface fasteners, mating fasteners and other complementary devices having a profiled structure. In a preferred embodiment, the complementary fastener strips may include complementary profiled structures on either one or both sides of the strip.

Figure 2:
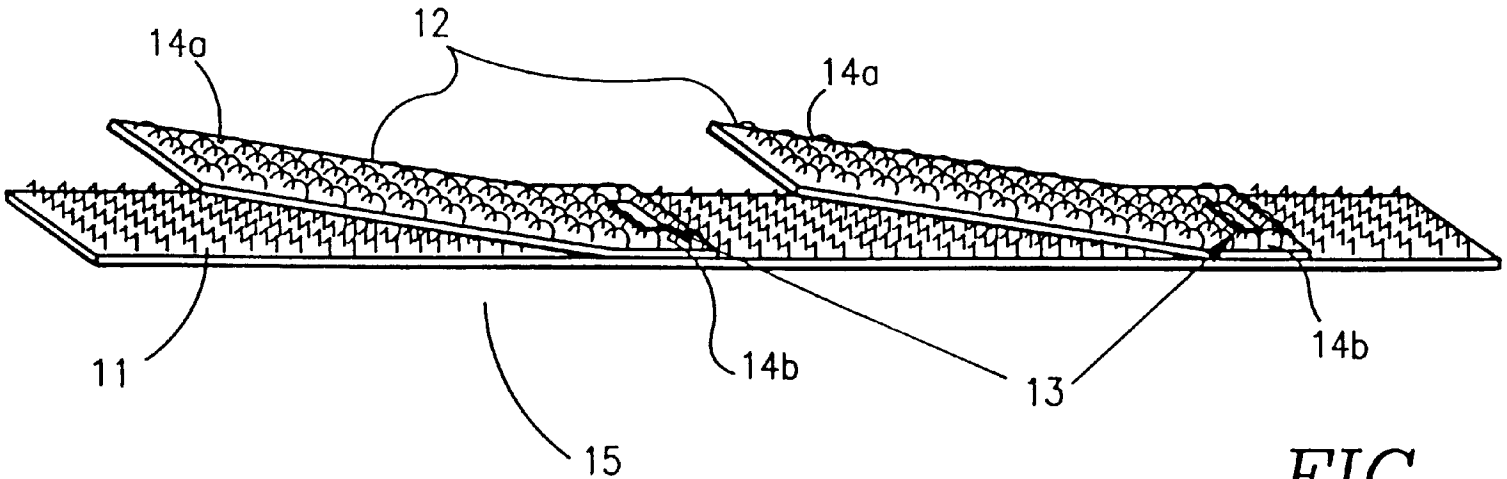
FIG. 2 shows a perspective view of one of the embodiments of the complementary fastener strip product.

FIG. 1 discloses a general arrangement of a complementary fastener strip product. The product consists of a first length of complementary fastener strip material 2*a*, and a second length of complementary fastener strip material 2*b*. The material is bound together at spaced intervals 3*a*, 3*b*, 3*c* to provide an indefinite length complementary fastener strip product 1. Another preferred embodiment of the present invention is shown in FIG. 2, which discloses an alternate embodiment of the complementary fastener strip product 15. In FIG. 2, a first length of complementary fastener strip material 11 is provided. Multiple lengths of complementary fastener strip material 12 are also provided having a first end 14*a* and a second end 14*b*. The multiple lengths of complementary fastener strip material 12, are then bound at one end 14*b*, to the first length of complementary fastener strip material 11, at spaced intervals 13, thereby securing the second end 14*b*, and allowing the first end 14*a* to remain free.

Figure 4:
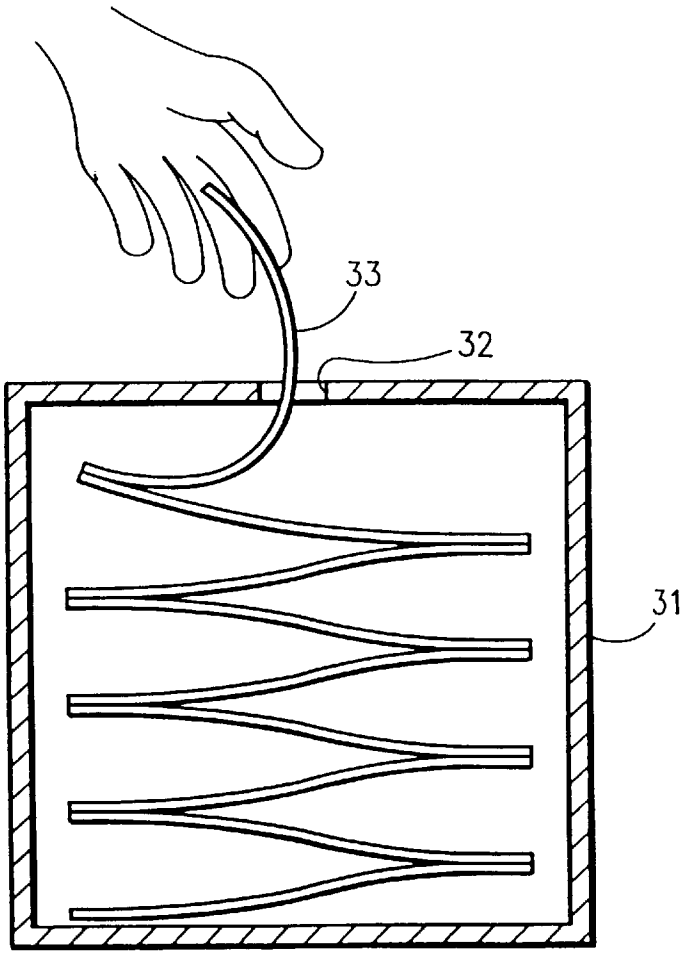
FIG. 4 shows a perspective view of one of the embodiments of the complementary fastener strip product dispenser.
Figure 3:
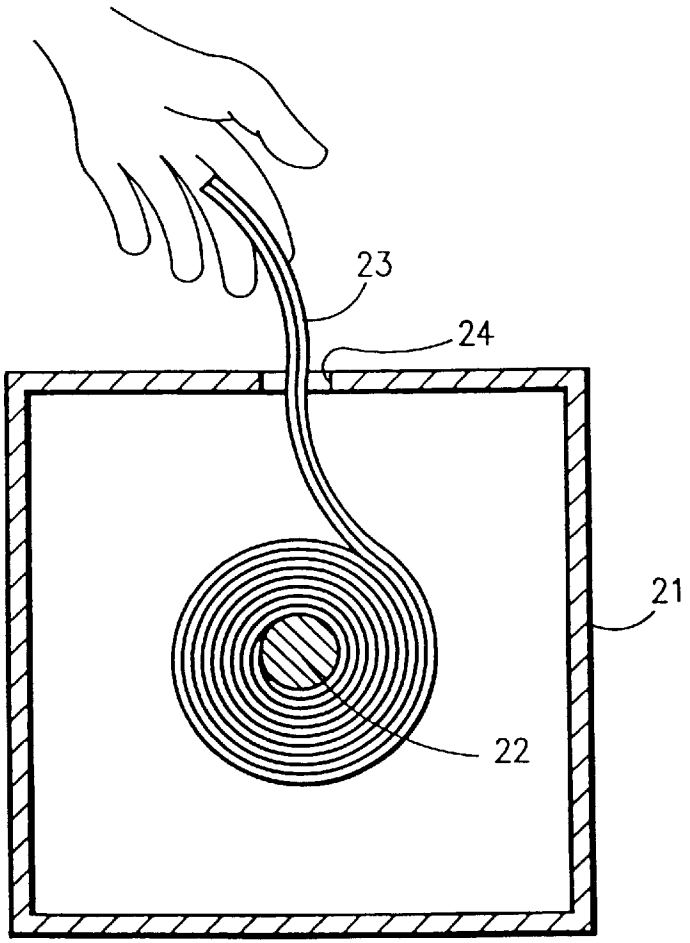
FIG. 3 shows a side cut-away view of one embodiment of the complementary fastener strip product dispenser.

FIG. 3 discloses a general arrangement for a complementary fastener strip dispenser. The preferred embodiment consists of a container 21, having a central axle 22, for holding a complementary fastener strip product 23, and a dispensing opening 24, for allowing access to the strip product 23. It should be understood that although central axle 22 is disclosed in the preferred embodiment, the present invention is not limited as such, in that other devices that perform the function of facilitating the spinning of the rolled up strip product 23 may be employed. For example, detent balls on either side of container 21 that can mate with opposite ends of a central member disposed inside of a roll strip product 23, may be used. Moreover, a central axle or the like is not required in that a roll of strip product 23 may be disposed in container 21 to rotate freely when strip product 23 is removed. FIG. 4 shows an alternative embodiment for a complementary fastener strip dispenser. A container 31, is filled with a complementary fastener strip product 33. The container 31, also includes a dispensing opening 32, for allowing access to the strip product 33.

The complementary fastener strip products shown in FIG. 1 or 2 are placed in the container 21 shown in FIG. 3 in a circular fashion. This packaging configuration allows for the continuous access to the complementary fastener strip product 23, through the container dispensing opening 24. Alternatively, the complementary fastener strip products shown in FIG. 1 or 2 may be placed in the container 31 shown in FIG. 4, in a stacked fashion. This alternative packaging configuration also allows for continuous access to the complementary fastener strip product 33, through the container dispensing opening 32.

Figure 5:
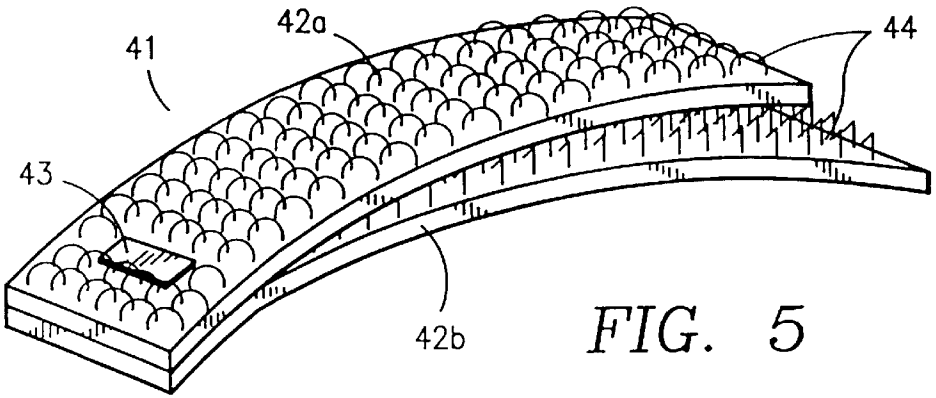
FIG. 5 shows a perspective view of one of the products which result from the present invention.
Figure 6:
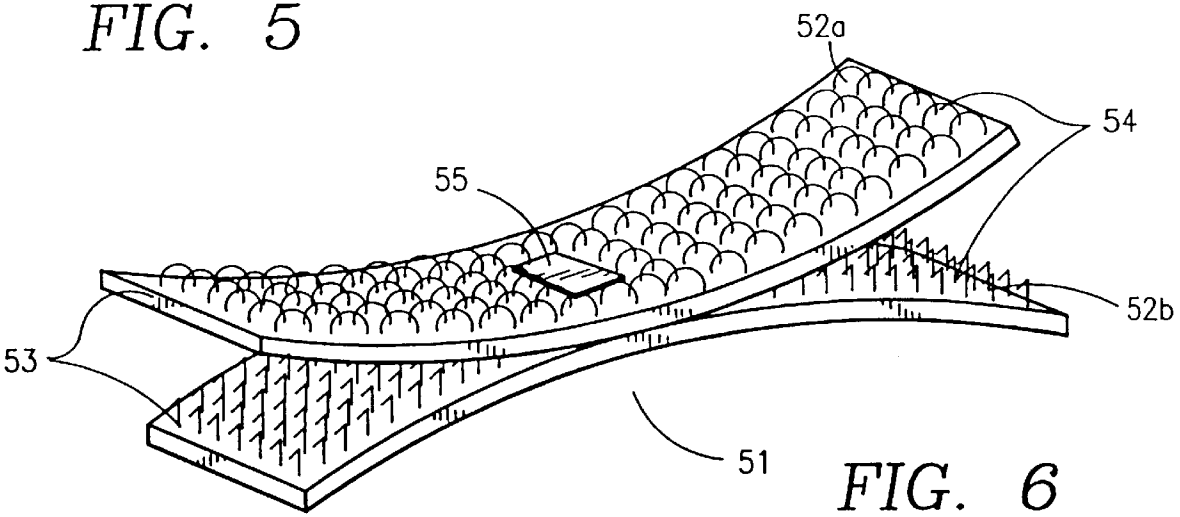
FIG. 6 shows a perspective view of one of the products which results from the present invention.

In use, container 21, as shown in FIG. 3, is placed in a convenient place, such as a furniture cushion manufacturing facility, and the complementary fastener strip product 23 is removed through the container dispensing opening 24. The complementary fastener strip product 23 may be as embodied in FIG. 1. As the complementary fastener strip product 1 embodied in FIG. 1 is withdrawn from the container 21, it may be severed at a point intermediate to binding points 3*a* and 3*b*, and immediately proximate to binding point 3*a*. The resulting product 41 is shown in FIG. 5, having two strips of complementary fastener 42*a*, 42*b* bound at one end 43, and unbound at its opposite end 44. The complementary fastener strip product 1 may also be severed at a point substantially intermediate to binding points 3*a* and 3*b*, and not immediately proximate to binding points 3*a* or 3*b*. The resulting product 51 is shown in FIG. 6, having two strips of complementary fastener 52*a*, 52*b* bound at a point 55 substantially intermediate to the two ends of the product 53, 54. The resulting product may then be attached to an article, such as an outdoor furniture cushion. The product may also be attached to the internal filler of the outdoor furniture cushion or to the exterior liner.

Figure 7:
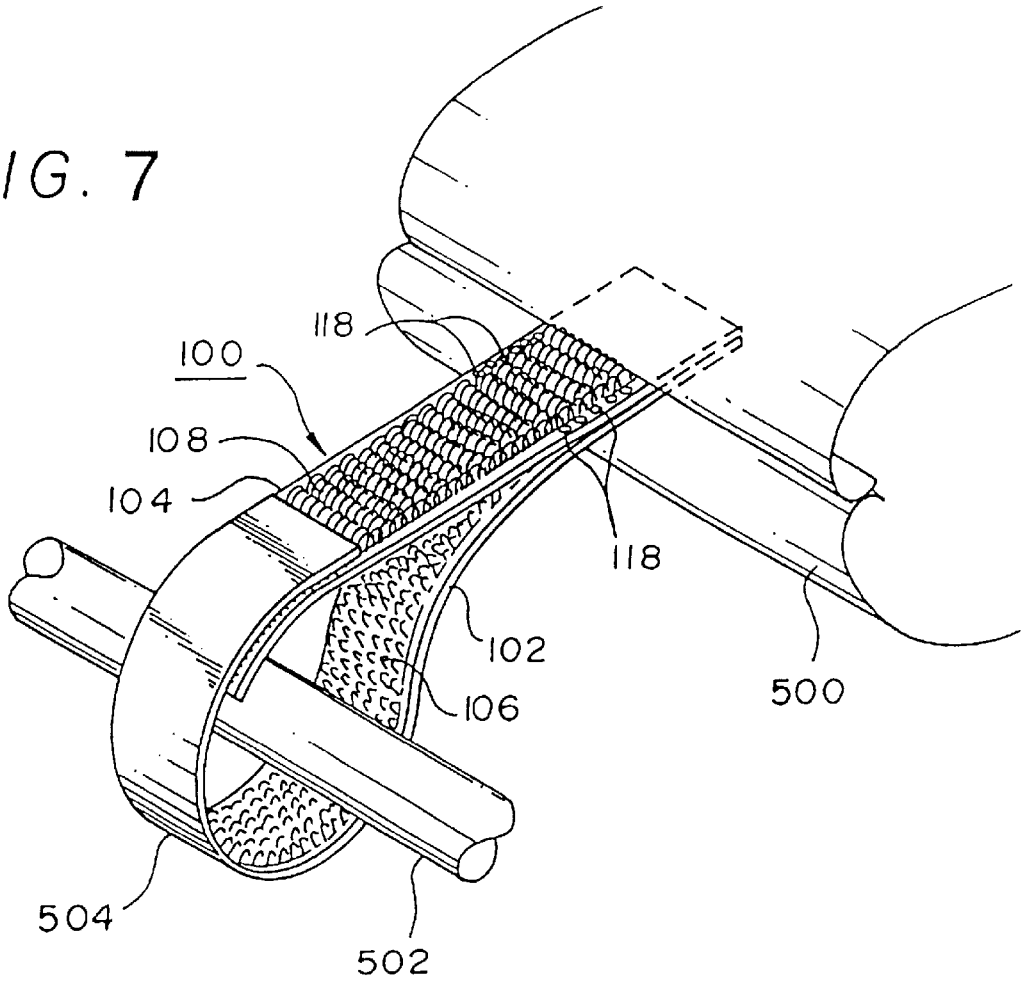
FIG. 7 shows an environmental user of the fastener assembly.

FIG. 7 shows an environmental use of the fastener assembly 100 is shown. The fastener assembly 100 is attached to a product 500. The product 500 can be any product, which needs to be temporarily attached to another object 502. The bonds 118 are broken and first fastener strip 102 and the second fastener strip 104 are wrapped around the object 502 such that the first fastening face 106 over laps and meets with the second fastening face 108 in an area 504. The product 500 is now temporarily attached to the object 502 and can easily be removed.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A method of securing complementary fastener strips, comprising:

providing a first length of a fastener strip having at least one complementary fastening face;

providing a second length of a fastener strip having at least one complementary fastening face;

binding said second fastener strip to said first fastener strip at an predetermined intervals along the first length of fastener strip;

wherein said first length of fastener strip is bound to said second length of fastener strip such that the complementary face of one fastener strip abuts a non-complementary face of the other fastener.

2. A method as described in claim 1, wherein said fasteners are hook and loop fasteners.

3. A method as described in claim 1, further including the severing of said fastening strips at points on either side of said predetermined binding intervals after dispensing.

4. A method of securing complementary fastener strips, comprising:

providing a first length of a fastener strip having at least one complementary fastening face;

providing a second length of a fastener strip having at least one complementary fastening face;

binding said second fastener strip to said first fastener strip at an intermediate location along the first length of fastener strip;

said binding being located at predetermined intervals;

wherein said first length of fastener strip is bound to said second length of fastener strip such that the complementary face of one fastener strip abuts a non-complementary face of the other fastener strip; and severing said fastening strips at points on either side of said predetermined binding intervals after dispensing.

5. A method of securing complementary fastener strips, comprising:

providing a first length of a fastener strip having at least one complementary fastening face;

providing a second length of a fastener strip having at least one complementary fastening face;

binding said first fastener strip to said second fastener strip at predetermined intervals;

wherein said complementary face of said first fastener strip abuts a non-complementary face of said second fastener strip;

providing a dispenser for dispensing said complementary fastener strips; and severing said fastener strips, after dispensing, at a point on either side of said predetermined intervals to provide a product having a proximal bound end and a distal unbound end.

6. A method of as described in claim 5, further including, providing a furniture cushion; and attaching said bound end to the periphery of said furniture cushion.

7. A method as described in claim 6, further including placing said furniture cushion on an article of furniture having a cushion securement attachment capable of allowing said distal unbound ends to encircle said cushion securement attachment; and attaching said cushion to said article of furniture through mating of said complementary faces.

8. A method according to claim 6, further including placing said furniture cushion on an article of furniture having a cushion securement attachment capable of allowing said distal unbound ends to complementary mate with said article of furniture.

* * * * *

UNITED STATES PATENT AND TRADEMARK OFFICE

CERTIFICATE OF CORRECTION

PATENT NO. : 6,775,896 B2
DATED : August 17, 2004
INVENTOR(S) : Chester Dudek et al.

It is certified that error appears in the above-identified patent and that said Letters Patent is hereby corrected as shown below:

Column 1,
Line 17 and 23, delete “know” and insert -- known --.

Column 2,
Line 5, delete “sown” and insert -- sewn --.
Line 9, delete “know” and insert -- known --.

Column 3,
Line 3, delete “perspective” and insert -- side cut-away --.
Line 22 and 25, delete “know” and insert -- known --.

Signed and Sealed this

Twenty-first Day of September, 2004

JON W. DUDAS
*Director of the United States Patent and Trademark Office*